US011110369B1

(12) United States Patent
Lin et al.

(10) Patent No.: US 11,110,369 B1
(45) Date of Patent: Sep. 7, 2021

(54) AIR BUBBLE FORMING APPARATUS

(71) Applicant: HOLD ENTERPRISE CO., LTD., New Taipei (TW)

(72) Inventors: Shau-Chi Lin, New Taipei (TW); Yu-An Chen, New Taipei (TW)

(73) Assignee: HOLD ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 16/847,527

(22) Filed: Apr. 13, 2020

(51) Int. Cl.
*A63H 33/28* (2006.01)

(52) U.S. Cl.
CPC ..... *A63H 33/28* (2013.01)

(58) Field of Classification Search
CPC ..... A63H 33/28; A24F 13/30
USPC ..... 446/15–21
See application file for complete search history.

(56) References Cited

U.S. PATENT DOCUMENTS 208,102 A * 9/1878 Knapp ..... A63H 33/28 446/24
515,464 A * 2/1894 Commoss ..... A63H 33/28 446/24
612,121 A * 10/1898 Rakovsky ..... A63H 33/28 446/21
1,906,993 A * 5/1933 Millet ..... A63H 33/28 446/24
1,945,852 A * 2/1934 Gosliner ..... A63H 33/28 446/24
2,587,536 A * 2/1952 Scott ..... A63H 33/28 446/18
2,628,450 A * 2/1953 Shelton ..... F15D 1/009 446/24
2,788,607 A * 4/1957 Ward ..... A63H 33/28 446/24
2,882,643 A * 4/1959 Jianas ..... A63H 33/28 446/21
3,093,925 A * 6/1963 Greene ..... A63H 33/28 446/18
3,564,762 A * 2/1971 Crosman ..... A63H 3/31 446/185
3,834,066 A * 9/1974 Vargas ..... B05B 11/0056 446/21
3,925,923 A * 12/1975 La Fata ..... A63H 33/28 446/18
4,276,713 A * 7/1981 Crosbie ..... A63H 33/28 446/21
D277,879 S * 3/1985 Brown ..... D21/401
(Continued)

*Primary Examiner* — Eugene L Kim
*Assistant Examiner* — Matthew B Stanczak

(57) ABSTRACT

An air bubble forming apparatus includes a hollow apparatus body and an aerodynamic device. The apparatus body includes a shell, an air inlet, a hollow cavity and a bubble forming member. The bubble forming member includes an air outlet, a bubble fluid dipping portion, and a plurality of bubble apertures arranged around the air outlet. The aerodynamic device includes an elastic diaphragm, and an operating member, operating member connected to the elastic diaphragm. The elastic diaphragm separates the hollow cavity from the outside world. After the bubble fluid dipping portion is wetted with bubble fluid, the operating member is operated to deform the elastic diaphragm, and the air in the hollow cavity is pushed out through the air outlet and the plurality of bubble apertures to form air bubbles in the bubble apertures and to pop out the air bubbles to the outside.

9 Claims, 9 Drawing Sheets

(56) References Cited

U.S. PATENT DOCUMENTS

| | | | | | |
|---|---|---|---|---|---|
| 4,995,844 | A * | 2/1991 | McNett | A63H 33/28 | 446/15 |
| 5,042,819 | A * | 8/1991 | LaFata | A63H 33/28 | 273/349 |
| 5,205,771 | A * | 4/1993 | Sims | A63H 33/28 | 446/197 |
| 5,471,968 | A * | 12/1995 | Lee | F41B 11/89 | 124/59 |
| 6,953,376 | B1 * | 10/2005 | Kim | A63H 33/28 | 446/15 |
| 8,556,674 | B2 * | 10/2013 | Curry | F41B 9/0096 | 446/153 |
| 2003/0073374 | A1 * | 4/2003 | Thai | A63H 33/28 | 446/15 |
| 2006/0199463 | A1 * | 9/2006 | Thai | A63H 33/28 | 446/15 |
| 2012/0052965 | A1 * | 3/2012 | Curry | A63H 33/28 | 472/128 |
| 2012/0135664 | A1 * | 5/2012 | Lin | A63H 33/28 | 446/19 |
| 2015/0056884 | A1 * | 2/2015 | Fogarty | A63H 33/28 | 446/15 |
| 2020/0038774 | A1 * | 2/2020 | Williams | A63H 33/28 | |

* cited by examiner

AIR BUBBLE FORMING APPARATUS

BACKGROUND OF THE INVENTION

1. Field of the Invention

The present invention relates to bubble toy technology and more particularly, to an air bubble forming apparatus, which uses an airflow to guide the impulse, so that the adhered bubble fluid is driven to form air bubbles, and the air bubbles thus formed are popped out to the outside.

2. Description of the Related Art

The common structural design of existing bubble blowing toys generally comprises a container and a cover. The container is filled with a bubble fluid. The cover can close the opening of the container. The inner surface of the cover is provided with a rod member, and one end of the rod member forms a fluid dipping ring. When in use, hold the cover to dip the fluid dipping ring into the container so as to get the bubble fluid, and then blow air to the fluid dipping ring to produce air bubbles. There is known another bubble blower design that is a cone-shaped bubble blower. The smaller diameter end of the cone-shaped bubble blower is used as the blowing end, and the larger diameter end is used as the molding end. After the bubble fluid is attached to the larger diameter end of the cone-shaped bubble blower, air is blown in from the blowing end, so that the bubble fluid forms air bubbles at the molding end.

However, the floating distance and direction of the air bubbles blown by the above bubble blowing toys cannot be controlled by the user, which drastically reduces entertainment.

SUMMARY OF THE INVENTION

The present invention has been accomplished under the circumstances in view. It is therefore the main object of the present invention to provide an air bubble forming apparatus, which uses an airflow to guide the impulse, so that the adhered bubble fluid is driven to form air bubbles, and the air bubbles thus formed are popped out to the outside, as if shooting with an air gun. In this way, the invention not only efficiently generates multiple air bubbles, but also shoots an object with the air bubbles, which is so rich and interesting. Since no artificial blowing is required, the risk of touching the bubble fluid with the mouth can be avoided, thereby improving the safety of use.

To achieve this and other objects of the present invention, an air bubble forming apparatus comprises an apparatus body and an aerodynamic device. The apparatus body is a hollow member, comprising a shell, an air inlet, a hollow cavity and a bubble forming member. The bubble forming member comprises an air outlet, a bubble fluid dipping portion and a plurality of bubble apertures. The bubble apertures are arranged around the air outlet. The aerodynamic device is mounted in the apparatus body, comprising an elastic diaphragm and an operating member. The operating member is connected to the elastic diaphragm. The elastic diaphragm separates the hollow cavity from the outside world. The operating member is operable to elastically deform the elastic diaphragm, so that the air in the hollow cavity is pushed to flow out through the air outlet and the bubble apertures.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

In order to solve the problem that the bubble forming efficiency of existing air bubble forming apparatus is poor and the existing air bubble forming apparatus are easy to touch the mouth and endanger health, the inventor, through years of research and development, has invented an air bubble forming apparatus that has the characteristics of simple structure, convenient use, reducing the waste of bubble fluid, being capable of producing multiple air bubbles at the same time and being more interesting. The follow-up will detail how the invention uses an air bubble forming apparatus to achieve the most efficient functional requirements.

Figure 1:
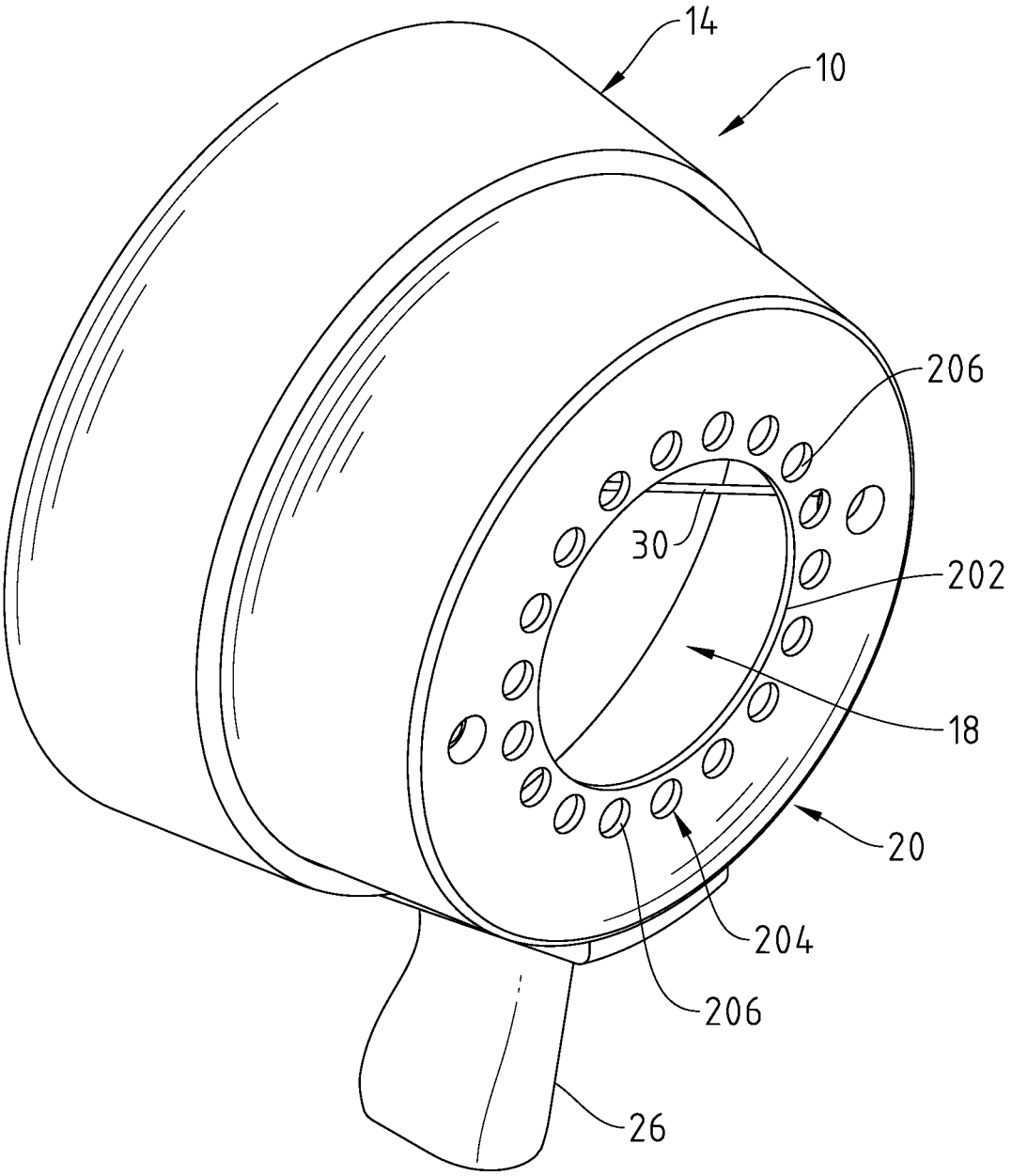
FIG. 1 is an oblique rear elevation of an air bubble forming apparatus in accordance with a first embodiment of the present invention.
Figure 2:
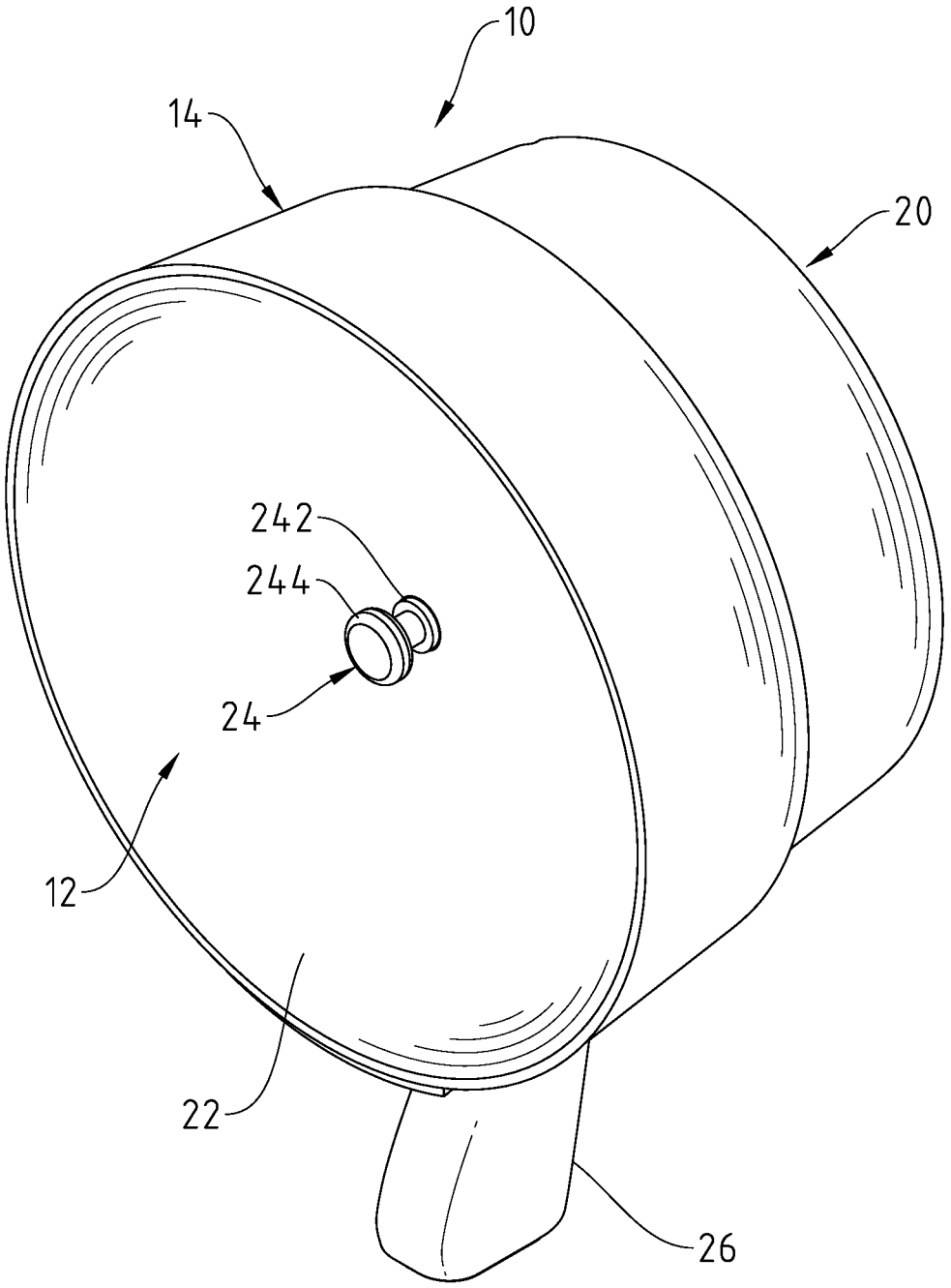
FIG. 2 is an oblique front elevation of the air bubble forming apparatus in accordance with the first embodiment of the present invention.

Referring to FIGS. 1 and 2, an oblique rear elevation and an oblique front elevation of an air bubble forming apparatus in accordance with a first embodiment of the present invention are shown. The air bubble forming apparatus comprises an apparatus body 10 and an aerodynamic device 12. The apparatus body 10 is a hollow body, comprising a shell 14, an air inlet 16, a hollow cavity 18 and a bubble forming member 20. The bubble forming member 20 comprises an air outlet 202, a bubble fluid dipping portion 204 and a plurality of bubble apertures 206. The bubble apertures 206 are arranged around the air outlet 20. The bubble forming member 20 is located at one end of the shell 14 away from the air inlet 16. The air outlet 202 communicates with the hollow cavity 18. The aerodynamic device 12 is mounted in the apparatus body 10. The aerodynamic device 12 comprises an elastic diaphragm 22 and an operating member 24. The operating member 24 is connected with the elastic diaphragm 22. The elastic diaphragm 22 separates the hollow cavity 18 from the outside world. The apparatus body 10 further comprises a grip 26 provided outside the shell 14. The grip 26 is for the user to hold and operate the apparatus body 10. The elastic diaphragm 22 is a thermoplastic elastic diaphragm. The thermoplastic elastomer (TPE) has rubber properties and the characteristics of plastic processing. It is a highly resilient, environmentally friendly, non-toxic and safe material. When the elastic diaphragm 22 is operated by the operating member 24 to produce elastic deformation, the air in the hollow cavity 18 is pushed out through the air outlet 202 and the multiple bubble apertures 206.

Figure 3:
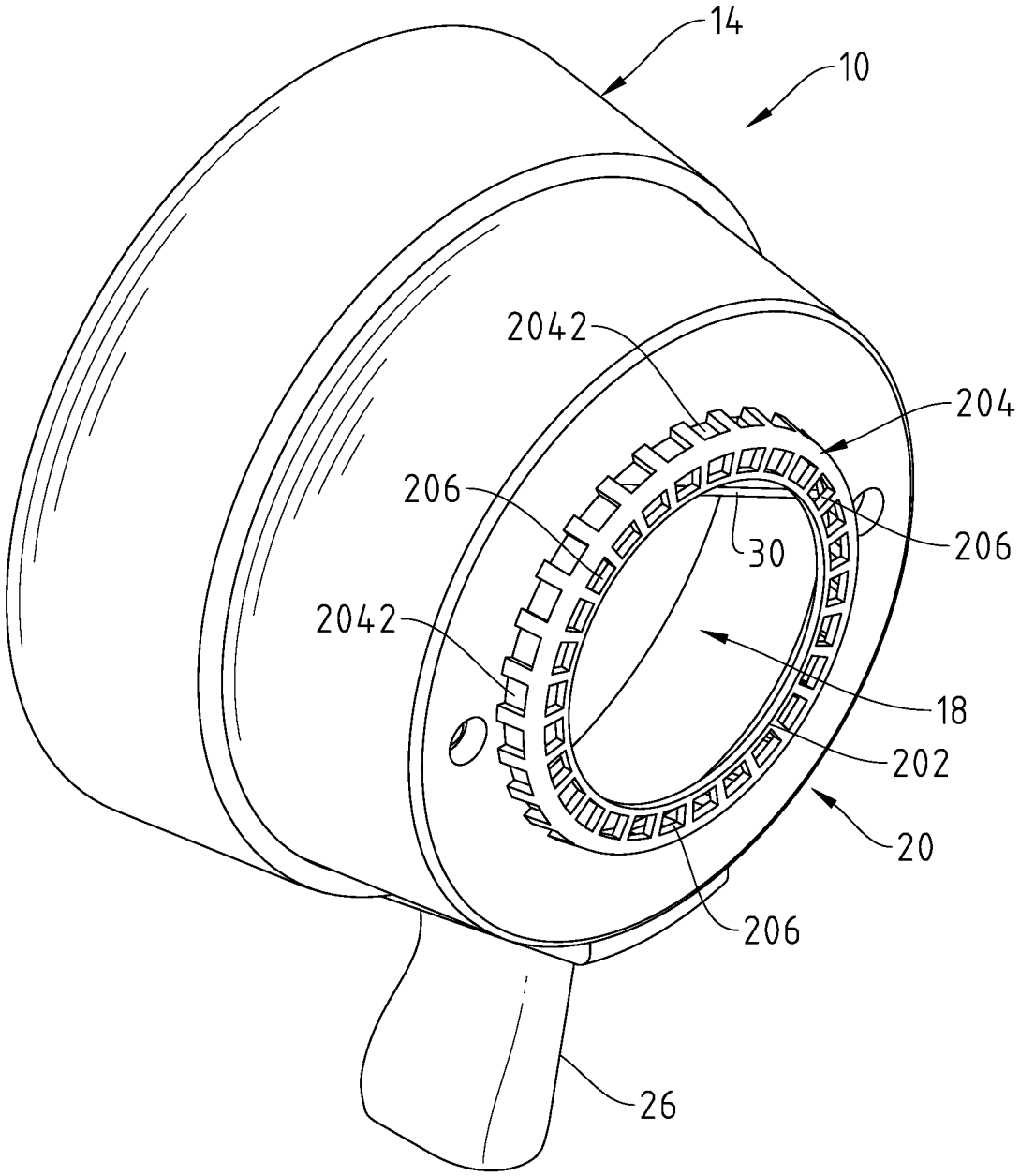
FIG. 3 is an oblique rear elevation of an air bubble forming apparatus in accordance with a second embodiment of the present invention.

FIG. 3 is an oblique rear elevation of an air bubble forming apparatus in accordance with a second embodiment of the present invention. This second embodiment is substantially similar to the aforesaid first embodiment with the exception that the bubble fluid dipping portion 204 of the bubble forming member 20 is a ring, and the ring is provided with a plurality of recesses 2042. Using the multiple recesses 2042 and the multiple bubble apertures 206 can attach more bubble fluid.

Figure 4:
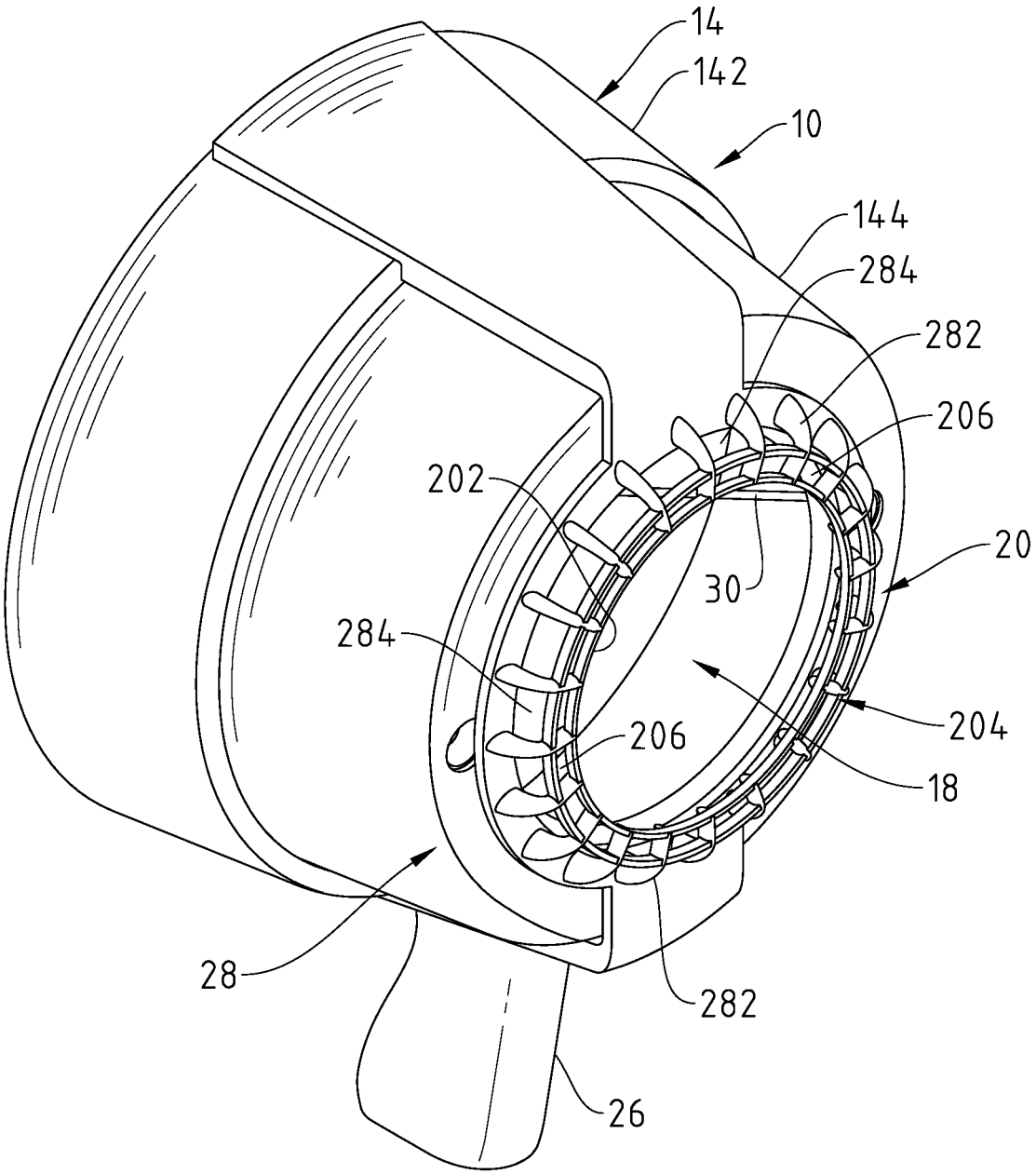
FIG. 4 is an oblique rear elevation of an air bubble forming apparatus in accordance with a third embodiment of the present invention.
Figure 5:
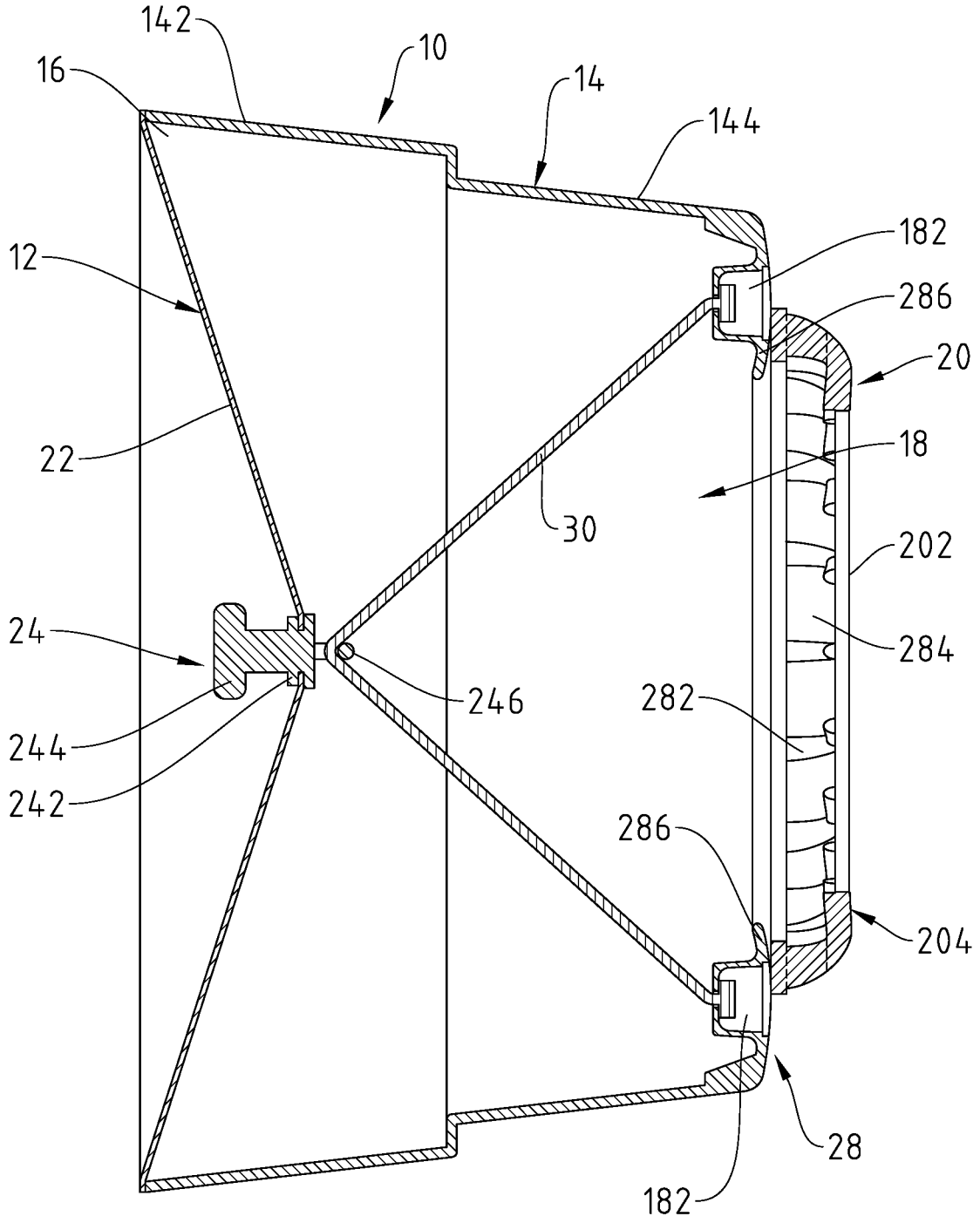
FIG. 5 is a sectional view of the air bubble forming apparatus in accordance with the third embodiment of the present invention.

Referring to FIGS. 4 and 5, an oblique rear elevation and a sectional view of an air bubble forming apparatus in accordance with a third embodiment of the present invention are shown. This third embodiment is substantially similar to the aforesaid first embodiment with the exceptions described hereinafter. The shell 14 comprises a first hollow tube 142 and a second hollow tube 144. The diameter of the first hollow tube 142 is larger than that of the second hollow tube 142. The first hollow tube 142 and the second hollow tube 144 are integrally formed. The operating member 24 comprises a clamping portion 242, an operating portion 244 and a fixing portion 246. The clamping portion 242 is clamped on opposing inner and outer surfaces of the elastic diaphragm 22. The operating portion 244 is located on the clamping portion 242 outside the elastic diaphragm 22. The aerodynamic device 12 further comprises an elastic element 30, which is an elastic rope, a spring, or any element having elastic deformation characteristics. The elastic element 30 is connected between the apparatus body 10 and the fixing portion 246. In one example of the present invention, the elastic element 30 is disposed in the hollow cavity 18. The hollow cavity 18 is provided with two symmetrical connecting portions 182, which are respectively connected to two opposite ends of the elastic element 30. The middle part of the elastic element 30 is fixed to the fixing portion 246. The preferred design of the fixing portion 246 is a hollow buckle. Of course, the invention does not limit the setting of the position of the elastic element 30.

Figure 6:
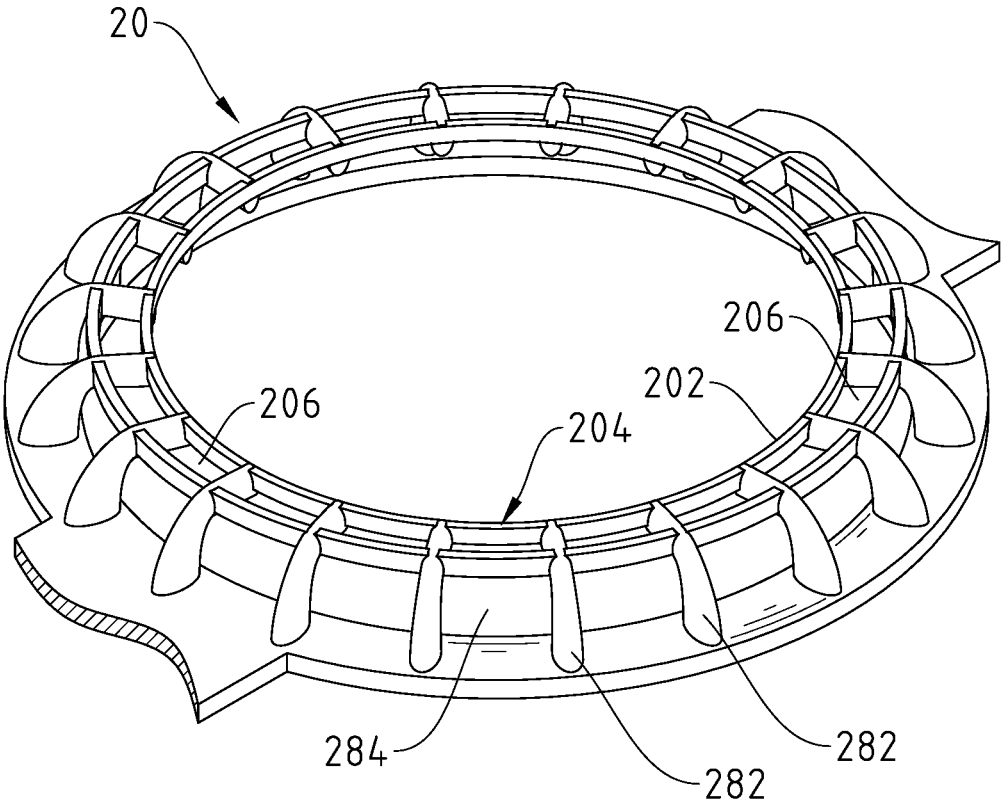
FIG. 6 is an enlarged elevational view of a part of the air bubble forming apparatus in accordance with the third embodiment of the present invention.

The air bubble forming apparatus further comprises an air buffer 28 set between the shell 14 and the bubble forming member 20. The air buffer 28 comprises a plurality of spacers 282, and a plurality of air guide holed 284 respectively disposed between each two adjacent spacers 282. The air buffer 28 further comprises an air baffle portion 286. The first hollow tube 142 has one end thereof configured to form the air inlet 16, and an opposite end thereof connected to the second hollow tube 142. The end of the second hollow tube 142 away from the air inlet 16 is provided with the air baffle portion 286, i.e., the air baffle portion 286 is located at one end of the hollow cavity 18 adjacent to the air outlet 202. The multiple spacers 282 keep the bubble apertures 206 away from the air baffle portion 286. Referring also to FIG. 6, the bubble fluid dipping portion 204 is a ring. The spacers 282 are equiangularly connected to the ring-shaped bubble fluid dipping portion 204. The position of each bubble aperture 206 corresponds to the leading edge between two adjacent spacers 282.

Figure 7:
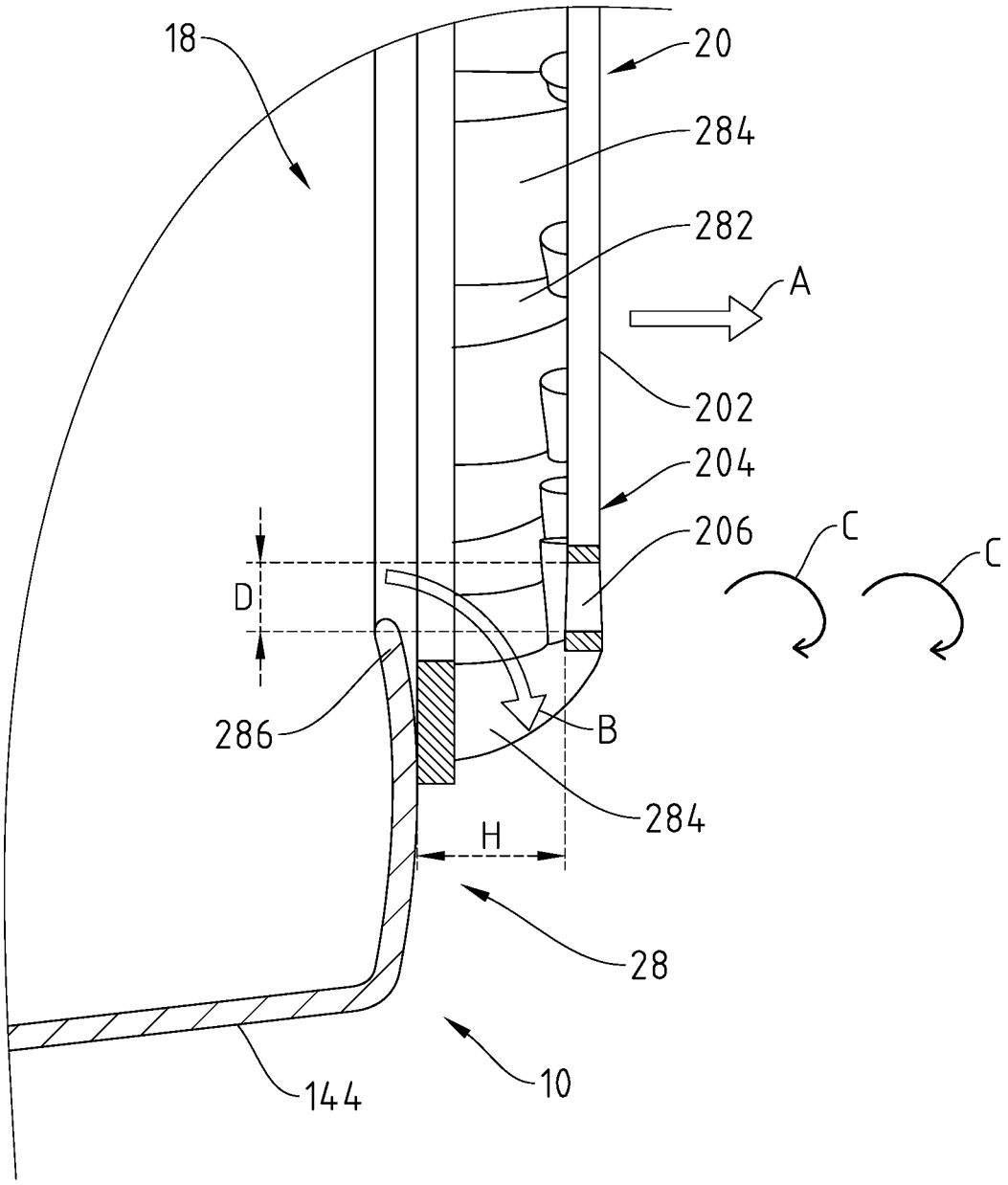
FIG. 7 is an enlarged sectional view of a part of the air bubble forming apparatus in accordance with the third embodiment of the present invention.

Referring to FIG. 7, to make the bubble formation more efficient, a distance H must be maintained between the length of the plurality of spacers 282 and the air baffle portion 286, so that a sufficient airflow guiding path is formed between the plurality of bubble apertures 206 and the air baffle portion 286. In detail, when the air pressure in the hollow cavity 18 is released instantly, the air velocity A of the air to the air outlet 202 is greater than the air velocity B of the air guide holes 284 between the adjacent spacers 282. With the rapid airflow A and the slow airflow B, the positions of the plurality of bubble apertures 206 form a swirling airflow C. This swirling airflow C is the key to forming complete air bubbles and driving the air bubbles to the outside. Therefore, the structural design that forms the best swirling airflow C is the distance between the length of the plurality of spacers 282 and the air baffle portion 286, which will allow the plurality of bubble apertures 206 to correspond to the position D between the air baffle portion 286 and the air outlet 202, or, to increase the distance H between the length of the plurality of spacers 282 and the air baffle portion 286 so that the position of the plurality of bubble apertures 206 corresponds to the position of the air baffle portion 286 (not shown in the drawing). The swirling airflow C is created by the air blocking effect of the air baffle portion 286 and the airflow guidance effect induced by the air baffle portion 286, the rapid airflow A and the slow airflow B.

Figure 8:
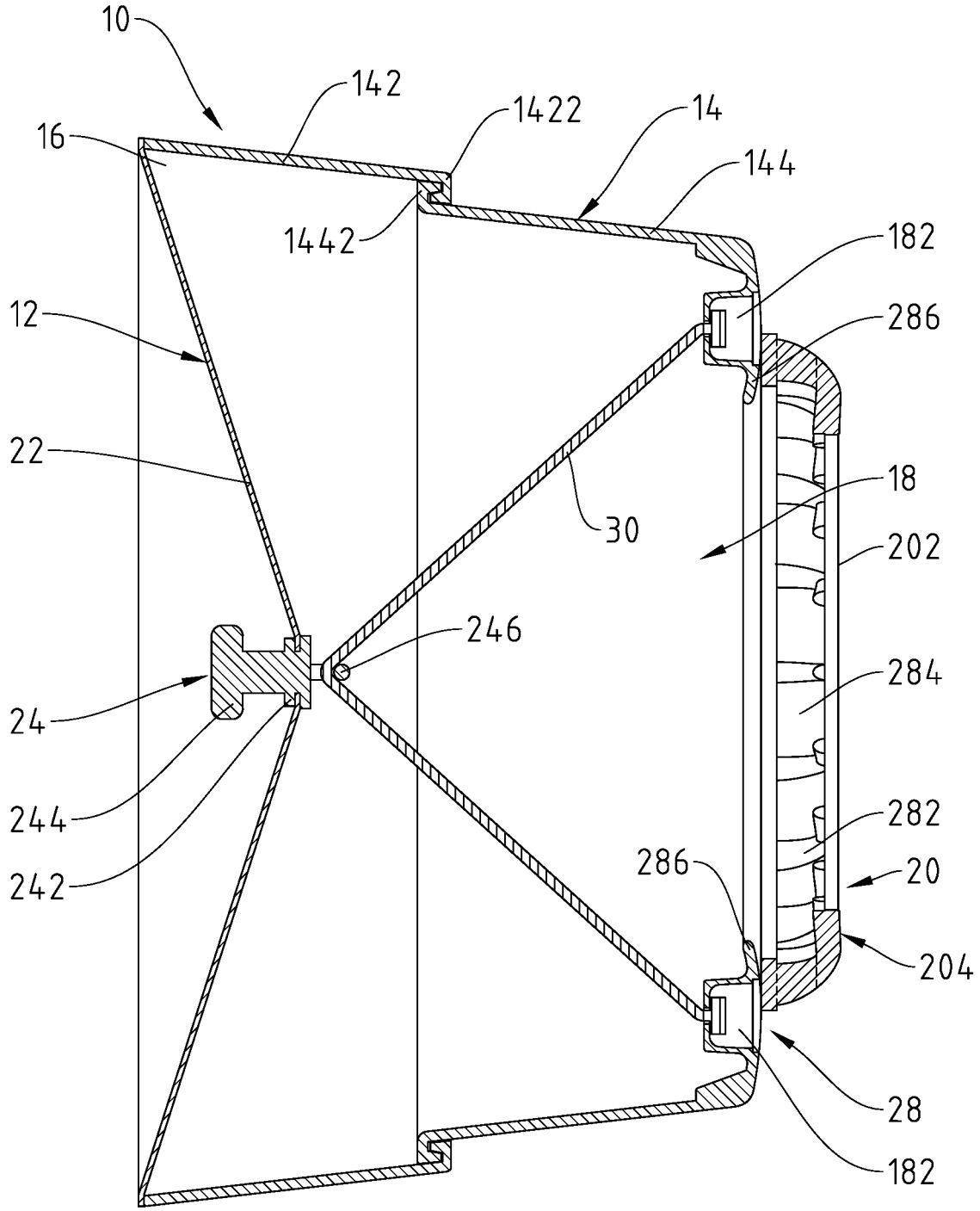
FIG. 8 is a sectional view of an air bubble forming apparatus in accordance with a fourth embodiment of the present invention.

FIG. 8 is an oblique rear elevation of an air bubble forming apparatus in accordance with a fourth embodiment of the present invention. This fourth embodiment is substantially similar to the aforesaid third embodiment with the exception that the edge of the diameter of the first hollow tube 142 is provided with a first engagement portion 1422; the edge of the diameter of the second hollow tube 144 is provided with a second engagement portion 1442; the first engagement portion 1422 is engaged with the second engagement portion 1442, so that the first hollow tube 142 and the second hollow tube 144 are connected together; the first hollow tube 142 internally communicates with the second hollow tube 144 to form the hollow cavity 18; the width of the hollow cavity 18 reduces gradually in direction away from the air inlet 16.

Figure 9:
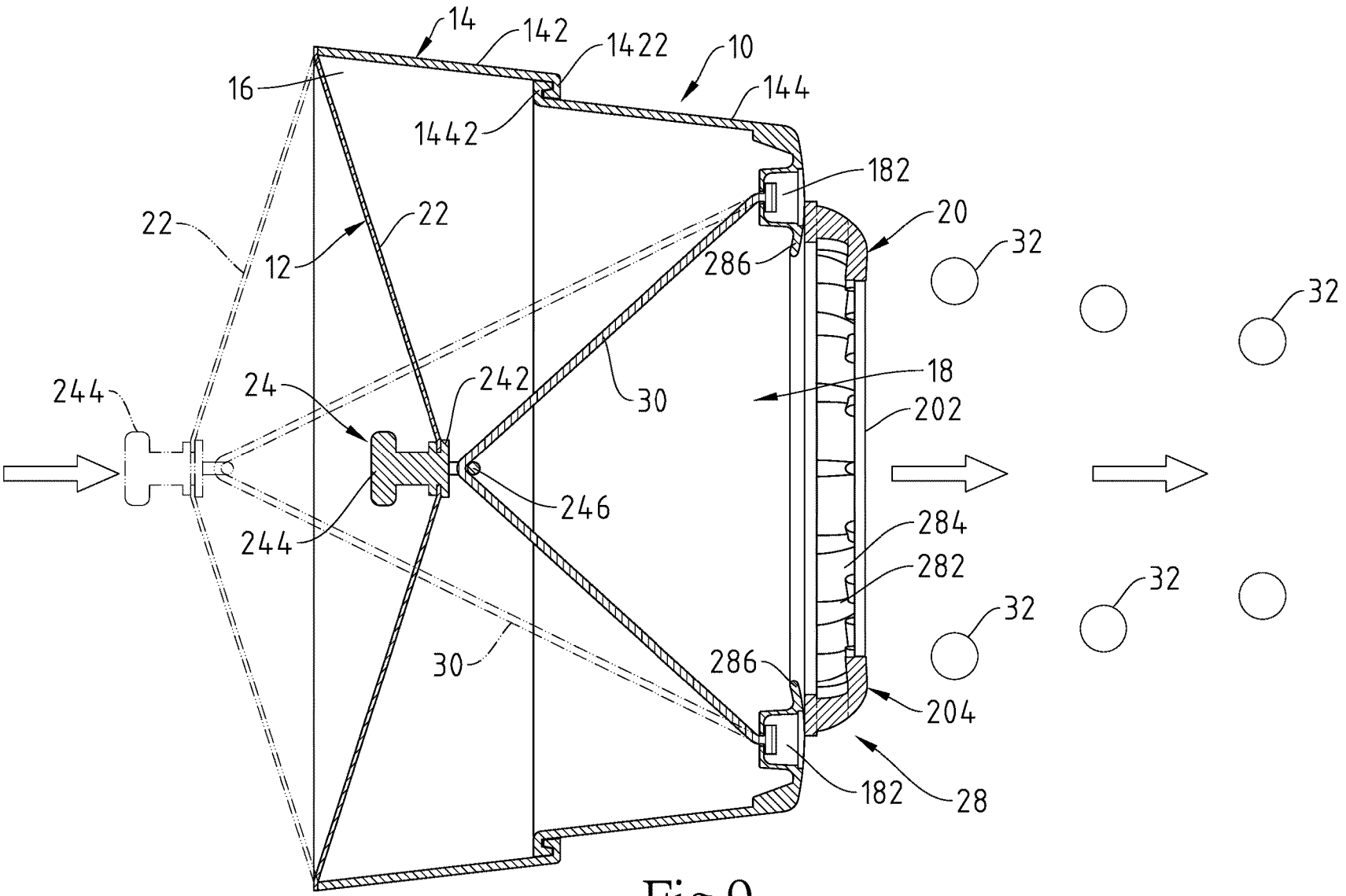
FIG. 9 is a schematic applied view of the present invention.

After understanding the above structure and composition, please refer to FIG. 9, which is a schematic diagram of the use status of the present invention. During use, hold the grip 26 to dip the bubble fluid dipping portion 204 into the bubble fluid (not shown). Then, operate the operating portion 244 of the operating member 24 to stretch the elastic element 30, thereby elastically deforming the elastic diaphragm 22 toward the air inlet 16. Because the elastic diaphragm 22 separates the hollow cavity 18 from the outside world, the air is first sucked into the hollow cavity 18 via the air outlet 202, and the internal air is compressed. After releasing the operating portion 244, the elastic diaphragm 2 and the elastic element 30 are elastically restored, and the air in the hollow cavity 18 is instantly pushed out through the air outlet 202 and the plurality of bubble apertures 206. The airflow is used to guide the impulse, so that the bubble fluid adhered to the multiple bubble apertures 206 is driven to form air bubbles 32, and the air bubbles 32 thus formed are popped out to the outside, as if shooting with an air gun. In this way, the invention not only efficiently generates multiple air bubbles, but also shoots an object with the air bubbles, which is so rich and interesting. Since no artificial blowing is required, the risk of touching the bubble fluid with the mouth can be avoided, thereby improving the safety of use.

What is claimed is:

1. An air bubble forming apparatus, comprising:

an apparatus body being a hollow member, said apparatus body comprising a shell, a hollow cavity, and a bubble forming member, said bubble forming member comprising an air outlet, a bubble fluid dipping portion and a plurality of bubble apertures, said bubble apertures being arranged around said air outlet; and an aerodynamic device mounted in said apparatus body, said aerodynamic device comprising an elastic diaphragm and an operating member, said operating member being connected to said elastic diaphragm, said elastic diaphragm covering an end of said apparatus body opposite said bubble forming member, said operating member being operable to elastically deform said elastic diaphragm, so that air in said hollow cavity is pushed to flow out through said air outlet and said bubble apertures;

wherein an air buffer is disposed between said shell and said bubble forming member, said air buffer comprising a plurality of spacers, and a plurality of air guide holes, said air guide holes being respectively formed between two adjacent said spacers.

2. The air bubble forming apparatus as claimed in claim 1, wherein the air buffer further comprises an air baffle portion, said air baffle portion being located at one end of said hollow cavity adjacent to said air outlet, said spacers spacing said bubble apertures from said air baffle portion.

3. The air bubble forming apparatus as claimed in claim 2, wherein said bubble apertures are disposed between said air baffle portion and said air outlet.

4. The air bubble forming apparatus as claimed in claim 2, wherein said bubble apertures are disposed corresponding to said air baffle portion.

5. The air bubble forming apparatus as claimed in claim 1, wherein said operating member comprises a clamping portion and an operating portion, said clamping portion being clamped on opposing inner and outer surfaces of said elastic diaphragm, said operating portion being located on said clamping portion, said operating portion being disposed outside said elastic diaphragm.

6. The air bubble forming apparatus as claimed in claim 1, wherein said operating member further comprises a fixing portion; said aerodynamic device further comprises an elastic element disposed in said hollow cavity, said elastic element coupled between said apparatus body and said fixing portion.

7. The air bubble forming apparatus as claimed in claim 6, wherein said elastic element is an elastic rope or a spring.

8. The air bubble forming apparatus as claimed in claim 1, wherein said apparatus body further comprises a grip disposed outside said shell.

9. The air bubble forming apparatus as claimed in claim 1, wherein said shell comprises a first hollow tube and a second hollow tube, a diameter of said first hollow tube being larger than a diameter of said second hollow tube, said first hollow tube comprising a first engagement portion located on an edge of a diameter thereof, said second hollow tube comprising a second engagement portion located on an edge of a diameter thereof, said first engagement portion and said second engagement portion being engaged with each other so that said first hollow tube and said second hollow tube are connected to form said hollow cavity therein.

* * * * *